US008011978B2

(12) United States Patent
Cortes Rico et al.

(10) Patent No.: US 8,011,978 B2
(45) Date of Patent: Sep. 6, 2011

(54) RETAINER, LAY-IN LUG ASSEMBLY NUT PLATE RETAINER

(75) Inventors: Gustavo Cortes Rico, Duluth, GA (US); Kristopher Scott Robinson, Atlanta, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 30 days.

(21) Appl. No.: 12/563,202

(22) Filed: Sep. 21, 2009

(65) Prior Publication Data

US 2010/0075546 A1 Mar. 25, 2010

Related U.S. Application Data

(60) Provisional application No. 61/098,838, filed on Sep. 22, 2008.

(51) Int. Cl.
*H01R 4/36* (2006.01)

(52) U.S. Cl. ..... 439/814

(58) Field of Classification Search ..... 439/810–814
See application file for complete search history.

(56) References Cited

U.S. PATENT DOCUMENTS 4,059,335 A * 11/1977 Simon ..... 439/813

* cited by examiner

*Primary Examiner* — Ross Gushi
(74) *Attorney, Agent, or Firm* — Jose R. de la Rosa

(57) ABSTRACT

The present invention relates generally to a lay-in lug nut plate retainer. More particularly, the invention encompasses a nut plate retainer for a lay-in lug assembly nut plate. The present invention is also directed to a novel lay-in nut plate retainer which provides an alternative way to secure a nut plate to a lay-in lug body during shipping and/or the installation process. The inventive nut plate retainer has a cover with an open area and at least two legs to surround a portion of the lay-in lug and the nut plate.

23 Claims, 4 Drawing Sheets

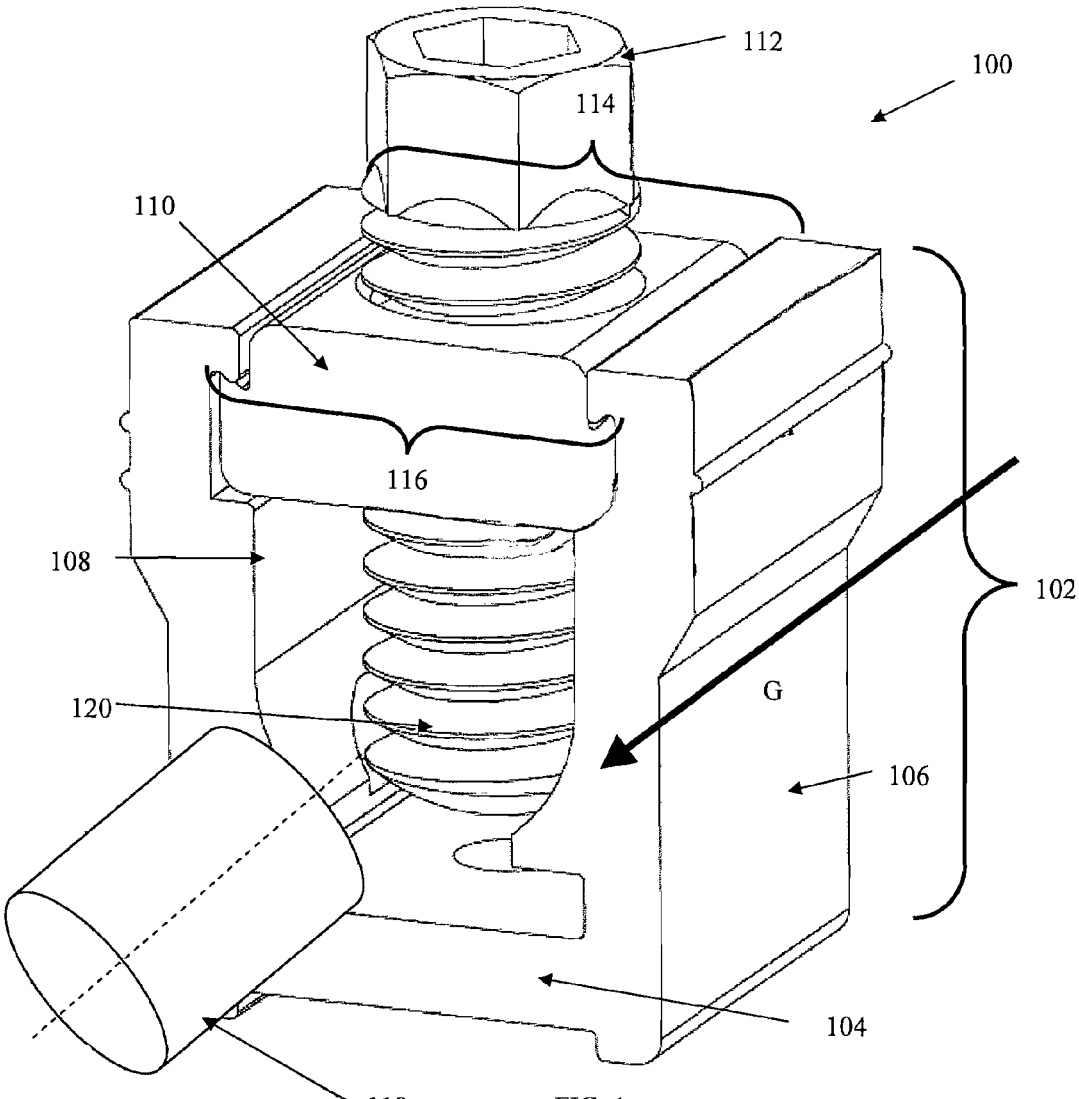
FIG. 1
(Prior Art)
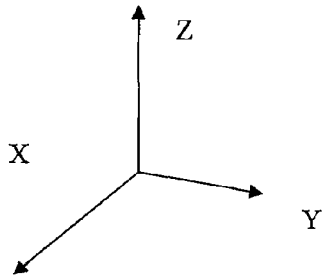

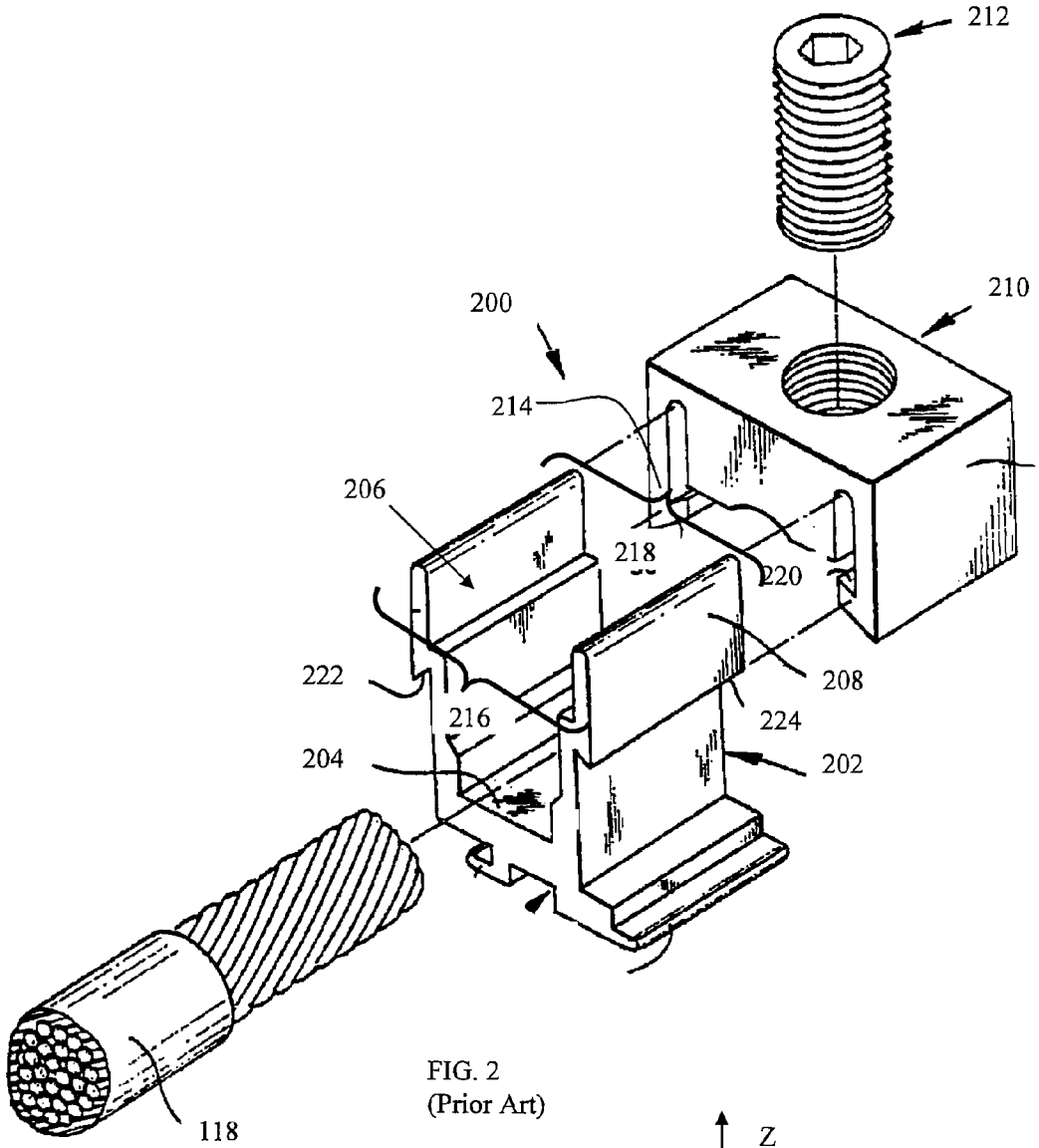
FIG. 2
(Prior Art)
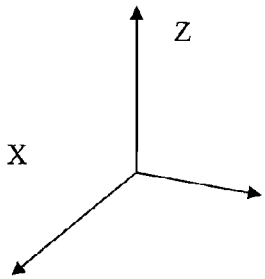

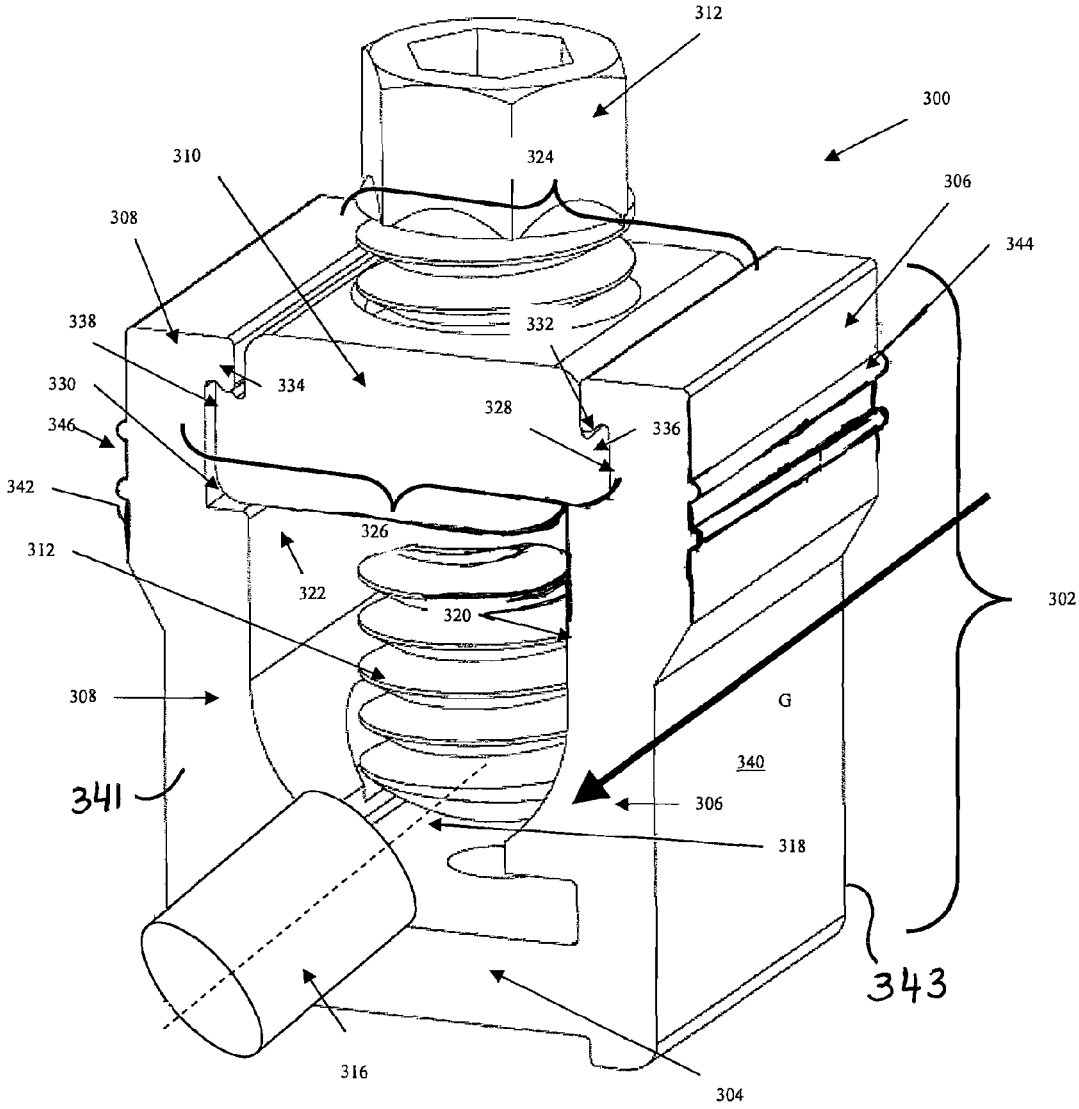
FIG. 3
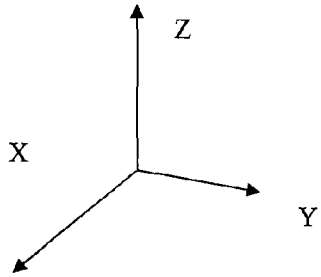

RETAINER, LAY-IN LUG ASSEMBLY NUT PLATE RETAINER

CROSS-REFERENCE TO RELATED APPLICATIONS

The instant patent application claims priority to and the benefit of U.S. patent application Ser. No. 12/150,803, filed on May 1, 2008, titled "Lay-In Lug Nut Plate Retainer," the entire disclosure of which application is incorporated herein by reference.

The instant patent application also claims priority to and the benefit of U.S. Provisional Patent Application Ser. No. 61/098,838, filed on Sep. 22, 2008, titled "Retainer, Lay-In Lug Assembly Nut Plate Retainer," the entire disclosure of which provisional application is incorporated herein by reference.

FIELD OF THE INVENTION

The present invention relates generally to a lay-in lug nut plate retainer. More particularly, the invention encompasses a nut plate retainer for a lay-in lug assembly nut plate. The present invention is also directed to a novel lay-in nut plate retainer which provides an alternative way to secure a nut plate to a lay-in lug body during shipping and/or the installation process. The inventive nut plate retainer has a cover with an open area and at least two legs to surround a portion of the lay-in lug and the nut plate.

BACKGROUND OF THE INVENTION

Lay-in lugs are provided in many electrical products as the means to electrically connect service or feed phase/neutral conductors to electrical metering equipment and/or circuit protection. All lay-in lug assemblies contain a lug body, a tapped plate (referred to as the nut plate) and a wire binding screw. During a typical installation with lay-in lug assemblies, the wire binding screw and the nut plate are removed by sliding out the nut plate prior to installing a phase/neutral conductor. Sliding-out the wire binding screw and nut plate provides top down access to the lug body. This simplifies the installation of a phase/neutral conductor to the lug body. Once the phase/neutral conductor has been installed the nut plate is slide-in and the wire binding screw is driven to the necessary torque requirements.

There are at least two types of nut plates used today in lay-in lug assemblies. Extruded-punched and formed plates are known to be used in existing applications. If the nut plate is of the extruded type, then the nut plate would only need to be secured in the direction of assembly (front to back with respect to the lug body). This means an additional bi-directional restraint is needed. In the extruded case, the nut plate, by default, would be constrained from top to bottom with respect to the lug body.

Currently, securing the nut plate to the lug body or limiting the nut plate's slide-out motion is achieved by driving the wire binding screw into the nut plate far enough such that the screw enters the wire way of the lug body and creates pressure that keeps the nut plate in place. The nut plate retention in the assembly is dependent on the location and torque of the wire binding screw. One problem with this method is that if the screw is not properly assembled the nut plate and screw sometimes falls out during transit or during installation of the enclosure. This increases the chances for the nut plate to be misplaced, lost, or in some cases fall in unreachable places. When this happens replacement parts must be shipped or in extreme cases, finished goods replaced. This is a costly and timely burden for the manufacturer and distributor, as well as, an aggravation for the customer.

This invention improves on the deficiencies of the prior art and provides an inventive lay-in lug assembly nut plate retainer.

PURPOSES AND SUMMARY OF THE INVENTION

The invention is a novel lay-in lug assembly nut plate retainer.

Therefore, one purpose of this invention is to provide a nut plate retainer for a lay-in lug assembly.

Another purpose of this invention is to provide a reliable solution to use a nut plate retainer for a lay-in lug assembly.

Yet another purpose of this invention is to provide a robust nut plate retainer for a lay-in lug assembly.

Therefore, in one aspect this invention comprises a lay-in lug comprising:

a first lug wall;

a second lug wall spaced apart from and substantially parallel to said first lug wall;

a nut plate supported between said first lug wall and said second lug wall; and a nut plate retainer configured to cover at least a portion of said first lug wall and said second lug wall, and substantially restrict said nut plate from moving in a direction substantially along said first and second lug walls relative to at least one open end in said lay-in lug.

In another aspect this invention comprises a nut plate retainer for preventing a nut plate of a lay-in lug from moving along a wall of said lay-in lug comprising:

a flexible retaining cover;

a first retaining leg extending from a first section of said retaining cover, wherein said first retaining leg covers at least a portion of a first outer wall of said lay-in lug, and restricts movement of a first end of said nut plate; and a second retaining leg extending from a second section of said retaining cover, wherein said second retaining leg covers at least a portion of a second outer wall of said lay-in lug, and restricts movement of a second end of said nut plate.

In yet another aspect this invention comprises a lay-in lug comprising:

a first lug wall;

a second lug wall spaced apart from and substantially parallel to said first lug wall;

a nut plate supported between said first lug wall and said second lug wall; and a retaining means configured to cover at least a portion of said first lug wall and said second lug wall, and substantially restrict said nut plate from moving in a direction substantially along said first and second lug walls.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which:

FIG. 1 illustrates a front perspective view of a prior art lay-in lug;

FIG. 2 illustrates a top-front perspective exploded view of a prior art lay-in lug;

FIG. 3 illustrates a front perspective view of a lay-in lug according to an embodiment of the invention;

DETAILED DESCRIPTION

Figure 4:
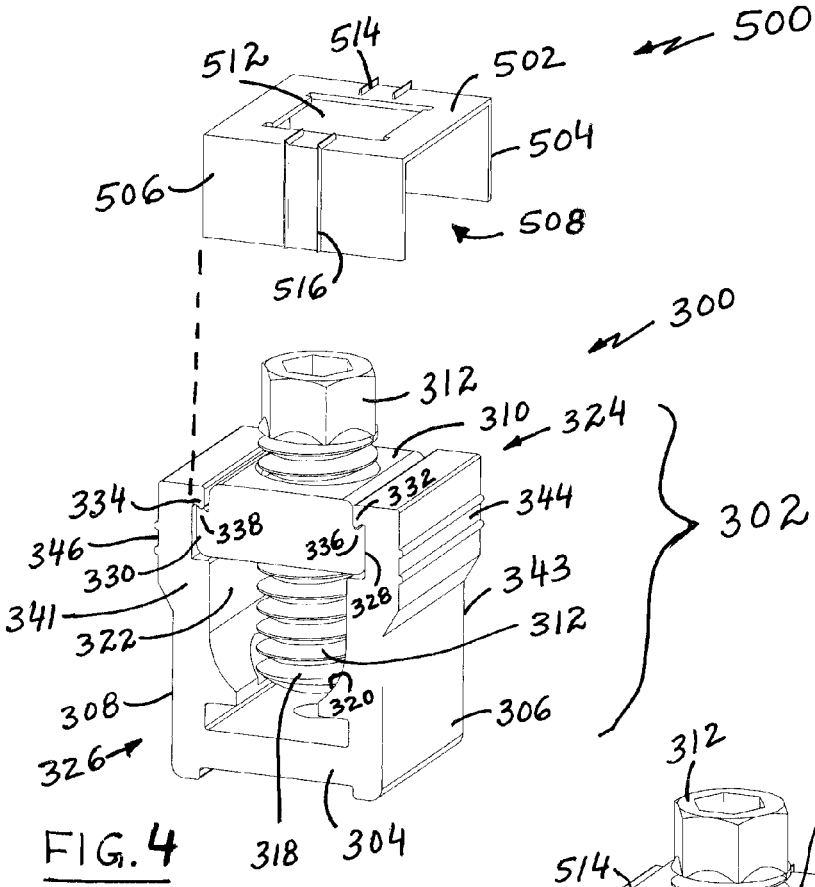
FIG. 4 illustrates an exploded view of a lay-in lug assembly and the inventive nut plate retainer according to an embodiment of the present invention.

This invention removes the dependency between nut plate retention and the binding screw location/torque. The lay-in lug nut plate retainer secures the nut plate to the lug body independently of the torque and position of the wire binding screw.

Lay-in lugs are similar to "C" or "J" type lugs, as are known, and are used to secure wires (e.g., electrical cables, wiring, tubing, etc.). Lay-in lugs are often used in electrical and similar applications to electrically connect service and/or feed phase-neutral conductors to electrical metering equipment and/or circuit protection. Lay-in lugs may be used in piping systems, such as electrical conduits and the like, to secure wires transposed vertically in a shaft, such as an electrical conduit riser. That is, lay-in lugs are used to hold (e.g., hang) wires vertically.

FIG. 1 is a front perspective view of an exemplary lay-in lug 100 as is known. Lay-in lug 100 has a lug body 102 comprising a base 104 and two opposed and substantially parallel vertical lug walls 106, 108. Supported between and/or atop lug walls 106 and 108 is a removable nut plate 110, which secures a wire binding screw 112.

In use (e.g., in an installation operation), lay-in lug 100 is secured to a surface (not shown) at its base 104. In vertical installation operations, lay-in lug 100 is secured such that the "open" ends 114 and 116 (e.g., sides of lug body 102 not dominated by a lug wall 106, 108) face substantially up and down, respectively (e.g., toward negative X and positive X, respectively). That is, lug walls 106 and 108 will be generally parallel to the direction of a gravity vector G and a secured wire 118. Nut plate 110, with wire binding screw 112 secured thereto, is removed from between lug walls 106, 108. This provides top down (e.g., positive Z to negative Z) access to the center channel 120 of lug body 102. Wire 118 (e.g., electrical cable, wiring, etc.) is laid in, pulled through, or otherwise transposed in the center channel 120 of lug body 102 between lugs walls 106 and 108, generally along the X axis. Nut plate 110 is returned to placement between and/or on top of lug walls 106, 108 and wire binding screw 112 is torqued (e.g., screwed, driven, etc.) to secure wire 118 between base 104 and wire binding screw 112 in the Z direction. Wire 118 is, of course, further secured laterally (e.g., in the Y direction) by lug walls 106, 108.

FIG. 2 depicts a top-front perspective exploded view of another known lay-in lug 200. Lay-in lug 200 is similar to lay-in lug 100 and has a lug body 202 having a lug base 204 and a pair of generally parallel, opposed lug walls 206 and 208. Lay-in lug 200 also has a nut plate 210 (e.g., a lug cap, top, etc.) attachable to the lug body 202 for capture of a wire 118 (e.g., electrical cable, etc.) with wire binding screw 212. As with lay-in lug 100, lay-in lug 200 has "open" ends 214 and 216 and nut plate 210 may be moved along an axis aligned between open ends 214, 216 (e.g., the X axis). The nut plate 210 of lay-in lug 200 has a pair of generally parallel nut plate ears 218 and 220 and respective nut plate flanges 222 and 224. As shown in FIG. 2, each of the nut plate flanges 222, 224 engages a respective lug body flange 226, 228 of the lug body 202. Such flange arrangements, as well as similar ridged arrangements, are used to secure nut plates (e.g., nut plates 110, 210, etc.) to lug bodies (e.g., lug bodies 102, 202, etc.) in a vertical (e.g., Z) direction.

For simplification of discussion, the XYZ axes of FIGS. 1 and 2, as well as FIGS. 3-6 below, may be assumed to be fixed to the lugs 100, 200, 300. Though lugs 100, 200, 300 may be oriented in other manners in real world applications, the lugs 100, 200, 300 are described as non-rotating within the coordinate system. For example, in the context of the present application, the Z axis always refers to the "up-and-down" direction extending through nut plates 110, 210, 310 and bases 104, 204, 304, irrespective of whether lugs 100, 200, 300 are placed on a "ground" surface, mounted to a wall, or are otherwise differently oriented.

The top-down (e.g., Z axis) access simplifies installation of wire 118 over prior "C" or "J" type lugs, but introduces a moveable and easily lost component—nut plate 110/210 with wire binding screw 112/212 attached. That is, since nut plate 110/210 is slideable and removable with respect to the rest of lug 100/200, nut plate 110/210 may inadvertently slide away from lug walls 106/206, 108/208 in transit and/or in installation. This is especially probable and problematic during the aforementioned electrical conduit riser type installation. Since the open end 116/216 of lug body 102/202 faces downward along the X axis (e.g., towards the ground or bottom and generally in the same direction as gravity vector G), nut plate 110/210 is not secured in lug body 102/202 in the vertical (e.g., up and down, along the X axis, etc.) direction and may slide or otherwise fall out due to the force of gravity exerted on nut plate 110/210 and wire binding screw 112/212.

Efforts have been made to prevent loss of nut plate 110/210 and wire binding screw 112/212. Generally, wire binding screw 112/212 is driven (e.g., screwed) through nut plate 110/210 far enough that wire binding screw 112/212 passes through center channel 120 (similarly in FIG. 2) and is bound in lug base 104/204. Lug Body 102/202 may have to be additionally machined to have a counterbore to allow wire binding screw 112/212 to be driven into base 104/204. With the wire binding screw 112/212 driven to contact or otherwise engage (e.g., be limited by) base 104/204, nut plate 110/210 is bi-directionally secured along the X axis and will not slide out as it is constrained in the Y and Z axes by the lug walls 106/206, 108/208 and in the X axis by the interaction of wire binding screw 112/212 with base 104/204. Wire binding screw 112/212 may also engage inner vertical lug walls 106/206, 108/208 (e.g., as with a counterbore, etc.).

These efforts fall short in that wire binding screw 112/212 must be used to secure nut plate 110/210 in the X axis. This is not useful during the installation operations described above because the wire binding screw 112/212 must be disengaged from the base 104/204 when nut plate 110/210 is removed to lay wire 118. During replacement of the nut plate 110/210, gravitational forces act on the nut plate 110/210 in the X direction and the nut plate 110/210 and the wire binding screw 112/212 may fall before the wire binding screw 112/212 is biased against the wire 118 and nut plate 110/210 interacts with the lug walls 106/206, 108/208 (e.g., at flanges 218, 220, 222, and 224 and similarly in lug 100).

This invention improves on the prior art. The lay-in lug has two spaced apart and substantially parallel lug walls. A nut plate is supported between the first lug wall and the second lug wall. A nut plate retainer exerts force on a lug wall and restricts the nut plate from moving in a direction substantially parallel to the first and second lug walls. The nut plate retainer has a flexible retaining cover and a pair of retaining legs extending from the retaining cover. Each of the retaining legs surround a portion of the outer wall of the lay-in lug and restrict movement of the nut plate. The nut plate retainer can either snap around the open end of the lug wall or along the open end wall of the nut plate. It may also clip around the nut plate and prevents its movement in a direction along the inner surfaces of the lug walls.

Furthermore, the present invention generally provides an apparatus for securing nut plates in lay-in lugs.

FIG. 3 illustrates a front perspective view of a lay-in lug 300, according to an embodiment of the invention. Lay-in lug 300 may be similar to and improve on lay-in lugs 100 and 200 of FIGS. 1 and 2, respectively. Accordingly, similar features are not described in further detail except as necessary to elucidate embodiments of the present invention.

The lay-in lug 300 has a lug body 302 comprising a lug body base 304 and two opposed and substantially parallel vertical lug walls 306, 308. Supported between and/or atop lug walls 306 and 308 is a removable nut plate 310, which secures a wire binding screw 312. A nut plate retainer 500, shown in FIGS. 4 and 5, restricts nut plate 310 from moving in direction along lug walls 306, 308 (e.g., along the X axis). With nut plate 310 secured by lug walls 306, 308 and/or restricted by nut plate retainer 500, wire binding screw 312 biases a wire 316 in channel 318 against lug body base 304. The lug body 302, has a first or face wall 341, and a second or back wall 343.

Lay-in lug 300 may be formed and/or manufactured (e.g., extruded, cast, punched, etc.) using any appropriate material. In some embodiments, base 304 and/or lug body 302 may be constructed of conductive material. In the same or alternative embodiments, base 304 and/or lug body 302 may be plated with at least one conductive material. Body 302 and base 304 may be formed as a single component or may be manufactured separately and attached to each other.

Lug walls 306, 308 may be constructed in any manner that allows nut plate 310 to be secured between them in the Y axis as well as constrained in the Z axis, such as the configurations of FIGS. 1 and 2. Lug walls 306 and 308 each have respective inner surfaces 320 and 322. Thus, nut plate 310 may be described as moveable and/or slideable in a direction substantially along inner surfaces 320, 322 toward and/or away from unconstrained open ends 324, 326. The unconstrained open ends 324, 326, have the first wall 341, and the second wall 343, respectively.

In some embodiments, lug walls 306, 308 may have recessed wall channels 328, 330. Nut plate 310 may sit in, be supported in, and/or be moveably and/or slideably arranged in and/or on wall channels 328, 330. The wall channels 328, 330 may be closed channels that have some portion of lug walls 306, 308 overhanging edges of nut plate 310. In other embodiments, wall channels 328, 330 may be open channels with no portion of lug walls 306, 308 above nut plate 310 in the Z axis and nut plate 310 may be secured between lug walls 306, 308 in a tight fitting relationship (e.g., the spacing between opposed walls 306, 308 is slightly smaller than the width of nut plate 310 in the Y axis). In the same or alternative embodiments, wall channels 328, 330 may have wall flanges 332, 334 that may interlock with and/or otherwise engage a portion of nut plate 310, such as nut plate flanges 336, 338.

Additionally, respective outer surfaces 340, 342 of lug walls 306, 308 may have retainer channels 344, 346 formed thereon. In some embodiments, retainer channels 344, 346 may be recessed into outer surfaces 340, 342 of lug walls 306, 308. In the same or alternative embodiments, retainer channels 344, 346 may have one or more raised surfaces (e.g., bumps, flanges, etc.) extending from outer surfaces 340, 342.

Nut plate 310 may be a removable component formed and/or manufactured of a similar material to lug body 302. Nut plate 310 may be tapped to accommodate wire binding screw 312. In some embodiments, nut plate 310 may have a slightly smaller length (e.g., along the X axis) than the length (e.g., along the X axis) of lug walls 306, 308. In this way, nut plate 310 may allow nut plate retainer 500 to overhang and/or otherwise impinge on a wall channel 328, 330 and restrict movement of nut plate 310 as will be described in further details with respect to FIGS. 4 and 5.

Figure 5:
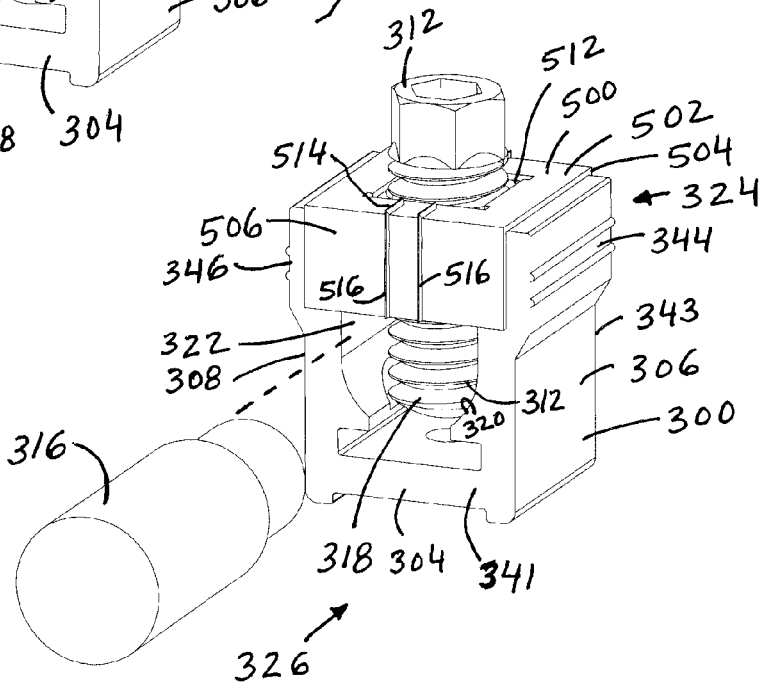
FIG. 5 illustrates a front perspective view of a lay-in lug assembly with the inventive nut plate retainer secured thereto according to an embodiment of the present invention.

FIG. 4 illustrates an exploded view of a lay-in lug assembly 300, and the inventive nut plate retainer 500, according to an embodiment of the present invention. While FIG. 5 illustrates a front perspective view of a lay-in lug assembly 300, with the inventive nut plate retainer 500, secured thereto according to an embodiment of the present invention. The inventive nut plate retainer 500, has a top wall or cover 502, having at least one hole or opening 512, and an open base 508. The nut plate retainer 500, has a first leg or wall or panel 504, and a second leg or wall or panel 506. In some embodiments the outer surface of the top wall or cover 502, could have at least one first or upper ridge or protrusion 514. In some embodiments the outer surface of the first wall 504, and/or the second wall 506, could have at least one second or side ridge or protrusion 516. It is preferred that the hole or opening 512, is sufficiently big so as to allow the passage of the wire binding screw 312, as more clearly shown in FIG. 5.

As can be seen in FIGS. 4 and 5, that the nut plate retainer 500 is a mechanism for restricting movement of the nut plate 310 along the X axis. Nut plate retainer 500 may be a fastener such as a spring clip or circlip and may restrict movement at both open ends of the nut plate 310 along the X axis (e.g., portions of nut plate 310 oriented toward open ends 324, 326). The nut plate retainer 500, when placed over the lay-in lug assembly 300, may overhang at least a portion of the wall channel 328, 330 and/or center channel 318. As a result, the nut plate retainer 500, prevents the nut plate 310, from sliding out of lug body 302, in the unconstrained direction (e.g., positive or negative X axis).

The nut plate retainer 500, may be formed as a single component or may comprise a separate top wall 502, retaining legs or walls 504, 506, which are then secured to each other so as to form the nut plate retainer 500. The nut plate retainer 500, may be formed from a flexible or semi-flexible material, such as thermoplastic. As a result, the nut plate retainer 500 may fit around the lug wall 341, 343 in a flexible but tight fitting relationship such that a portion of plate retainer 500 (e.g., retaining legs 504, 506) exerts a force against an open end 324, 326 edge of a lug wall 306, 308 in a direction substantially along the lug wall 341, 343, (e.g., along the X axis). In this way, plate retainer 500 exerts a force in one direction along the lug wall (e.g., in the positive X direction) as well as exerting a force in a substantially opposite direction along the lug wall (e.g., in the negative X direction). This secures plate retainer 500 to lug wall 341, 343 as well as restricting movement of the nut plate 310.

As will be understood from the description herein and the associated figures, the exact direction of the forces applied by the plate retainer 500 are not depicted. Based on the orientation and arrangement of certain portions of plate retainer 500 (e.g., retaining legs 504, 506) the resultant forces exerted on the lug body 302 and/or the nut plate 310 may differ slightly. One of skill in the art would recognize the plate retainer 500 restricts movement of the nut plate 310 as depicted in FIGS.

4 and 5 without confining the present invention to a specific point of contact or force direction.

The top wall or cover 502, may be a flexible (e.g., thermoplastic) member, and preferably in some embodiments, it is approximately the same length as the length of an outer surface of a lug wall (e.g., outer surface 341, 343) along the Y axis (e.g., in a direction substantially perpendicular to the direction of movement of the nut plate 310). In alternative embodiments, the top cover or wall 502 may be slightly shorter than an outer surface of lug wall 306, 308. In these embodiments, retaining legs 504, 506, may flex to snap fit the nut plate retainer 500 against and/or pinch an edge (e.g., at open end 324, 326, etc.) of the nut plate 310, along walls 341, 343.

The retaining legs 504, 506 may be flexible members, and in some embodiments, approximately the same length as the width of an edge surface of a lug wall (e.g., lug walls 341, 343 at open end 324 or 326) along the Y axis (e.g., in a direction substantially perpendicular to lug walls 306, 308 and the direction of movement of nut plate 310). In alternative embodiments, the retaining legs 504, 506, may be slightly shorter than an edge surface of lug wall 341, 343. In these embodiments, retaining legs 504, 506, may flex to snap fit plate retainer 500 against and/or pinch an edge (e.g., at the opening end 324, 326, etc.) of the nut plate 310, along walls 341, 343.

In operation, lay-in lug 300 is secured to a surface (not shown) at and/or by its base 304 (e.g., using mounting apparatus, etc.). In vertical installation operations, lay-in lug 300 is secured such that "open" ends 324 and 326 (e.g., sides of lug body 302 not dominated by a lug wall 306, 308) face substantially up and down, respectively (e.g., toward negative X and positive X, respectively). That is, the lug walls 304 and 306 will be generally parallel to the direction of a gravity vector G and a secured wire 316. Nut plate 310, with wire binding screw 312 secured thereto, is removed from between lug walls 306, 308. This provides top down (e.g., positive Z to negative Z) access to the center channel 318 of lug body 302. Wire 316 (e.g., electrical cable, wiring, etc.) is laid in, pulled through, or otherwise transposed in the center channel 318 of lug body 302 between lugs walls 306 and 308, generally along the X axis. Nut plate 310 is returned to placement between and/or on top of lug walls 306, 308 by sliding nut plate 310 along wall channels 328, 330 and interlocking flanges 332, 334, 336, 338. Wire binding screw 312 is torqued (e.g., screwed, driven, etc.) to secure wire 316 between base 304 and wire binding screw 312 in the Z direction. Wire 316 is further secured laterally (e.g., in the Y direction) by lug walls 306, 308.

Plate retainer 500 is clipped onto lug body 302. Retaining legs 504, 506 are set onto the outer surface 341, 343 and the retaining legs 504, 506, are secured around a portion (e.g., a portion at an open end 324, 326) of a lug wall 306, 308. Retaining legs 504, 506, exert a force on the wall surface 341, 343, and/or retaining legs 504, 506, exert a force on the end portion of the lug wall 306, 308. In this way, plate retainer 500 is secured to, clipped to, pinching, etc. a lug wall 306, 308. The nut plate retainer 500 thus serves as a stop which restricts the movement of the nut plate 310 along the walls 306, 308. In practice, only one plate retainer 500 may be used. However, any number and/or arrangement of nut plate retainers 500 may be used.

The nut plate retainer 500, is preferably made from a material selected from a group comprising a metallic material, a composite material, a plastic material, a thermoplastic material, to name a few.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

What is claimed is:

1. A lay-in lug comprising:

a first lug wall;

a second lug wall spaced apart from and substantially parallel to said first lug wall;

a nut plate supported between said first lug wall and said second lug wall; and a nut plate retainer, said nut plate retainer comprising a flexible retaining cover having an extended first retaining leg and an extended second retaining leg, and an opening between said extended first retaining leg and said extended second retaining leg, and said extended first retaining leg and said extended second retaining leg extends along at least a portion of said nut plate and are configured to cover at least a portion of said first lug wall and said second lug wall, and substantially restrict said nut plate from moving in a direction substantially along said first and second lug walls relative to at least one open end in said lay-in lug;

wherein said extended first retaining leg is configured to cover at least a portion of a first end of said first lug wall; and said extended second retaining leg is configured to cover at least a portion of a second end of said first lug wall.

2. The lay-in lug of claim 1, further comprising:

a first wall channel formed in said first lug wall;

a second wall channel formed in said second lug wall; and wherein said nut plate is slideably supported in first and second wall channels, and said nut plate retainer is configured to substantially restrict said nut plate from sliding along first and second wall channels.

3. The lay-in lug of claim 1, wherein said nut plate retainer is further configured to exert force in a first direction on a first portion of said first lug wall, and to exert force in a second direction substantially opposite said first direction on a second portion of said first lug wall.

4. The lay-in lug of claim 1, wherein said nut plate retainer is further configured to exert force in a first direction on a first end of said nut plate, and to exert force in a second direction on a second end of said nut plate.

5. The lay-in lug of claim 1, wherein said nut plate retainer is configured to cover at least a portion of a first end of said nut plate, and to cover at least a portion of a second end of said nut plate.

6. The lay-in lug of claim 1, wherein said nut plate retainer has at least one protrusion.

7. The lay-in lug of claim 1, wherein said opening between said extended first retaining leg and said extended second retaining leg in said nut plate retainer allows for the passage of a wire binding screw.

8. The lay-in lug of claim 1, wherein said nut plate retainer is made from a material selected from a group consisting of a metallic material, a composite material, a plastic material and a thermoplastic material.

9. A nut plate retainer for preventing a nut plate of a lay-in lug from moving along a wall of said lay-in lug comprising:

a flexible retaining cover;

a first retaining leg extending from a first section of said retaining cover, wherein said first retaining leg covers at least a portion of a first outer wall of said lay-in lug, and restricts movement of a first end of said nut plate; and a second retaining leg extending from a second section of said retaining cover, wherein said second retaining leg covers at least a portion of a second outer wall of said lay-in lug, and restricts movement of a second end of said nut plate.

10. The nut plate retainer of claim 9, wherein said first retaining leg is configured to exert force on said first outer surface of said wall of said lay-in lug at a first end and said second retaining leg is configured to exert a force on said second outer surface of said wall of said lay-in lug at a second end, said forces substantially parallel to said surface of said first wall and said second wall.

11. The nut plate retainer of claim 9, wherein said first retaining leg is configured to exert force on a first end of said first wall, and said second retaining leg is configured to exert force on a second end of said first wall, said forces exerted in opposite directions substantially parallel to said wall.

12. The nut plate retainer of claim 9, wherein said first retaining leg is configured to exert force on a first end of said nut plate, and said second retaining leg is configured to exert force on a second end of said nut plate, said forces exerted in opposite directions substantially perpendicular to said first end and said second end of said nut plate.

13. The nut plate retainer of claim 9, wherein said first and second retaining legs are open members.

14. The nut plate retainer of claim 9, wherein said flexible retaining cover comprises at least one opening to allow the passage of a wire binding screw.

15. The nut plate retainer of claim 9, wherein said flexible retaining cover is made from a material selected from a group consisting of a metallic material, a composite material, a plastic material and a thermoplastic material.

16. A lay-in lug comprising:

a first lug wall;

a second lug wall spaced apart from and substantially parallel to said first lug wall;

a nut plate supported between said first lug wall and said second lug wall; and a retaining means, said retaining means comprising a flexible retaining cover having an extended first retaining member and an extended second retaining member, and an opening between said extended first retaining member and said extended second retaining member, and said extended first retaining member and said extended second retaining member extends along at least a portion of said nut plate and are configured to cover at least a portion of said first lug wall and said second lug wall, and substantially restrict said nut plate from moving in a direction substantially along said first and second lug walls;

wherein said extended first retaining member is configured to cover at least a portion of a first end of said first lug wall; and said extended second retaining member is configured to cover at least a portion of a second end of said first lug wall.

17. The lay-in lug of claim 16, further comprising:

a first wall channel formed in said first lug wall;

a second wall channel formed in said second lug wall; and wherein said nut plate is slideably supported in first and second wall channels, and said retaining means is configured to substantially restrict said nut plate from sliding along first and second wall channels.

18. The lay-in lug of claim 16, wherein said retaining means is further configured to exert force in a first direction on a first portion of said first lug wall, and to exert force in a second direction substantially opposite said first direction on a second portion of said first lug wall.

19. The lay-in lug of claim 16, wherein said retaining means is further configured to exert force in a first direction on a first end of said nut plate, and to exert force in a second direction on a second end of said nut plate.

20. The lay-in lug of claim 16, wherein said retaining means is configured to cover at least a portion of a first end of said nut plate, and to cover at least a portion of a second end of said nut plate.

21. The lay-in lug of claim 16, wherein said retaining means has at least one protrusion.

22. The lay-in lug of claim 16, wherein said opening between said extended first retaining member and said extended second retaining member in said retaining means has at least one opening to allow allows for the passage of a wire binding screw.

23. The lay-in lug of claim 16, wherein said retaining means is made from a material selected from a group consisting of a metallic material, a composite material, a plastic material and a thermoplastic material.

* * * * *